US007380847B2

(12) United States Patent
Rodriguez et al.

(10) Patent No.: US 7,380,847 B2
(45) Date of Patent: Jun. 3, 2008

(54) DUMMY CONVERSION BRACKET FOR A LOCKSET

(75) Inventors: Lawrence G. Rodriguez, Anaheim, CA (US); Michael Winardi, Fullerton, CA (US)

(73) Assignee: Newfrey LLC, Newark, DE (US)

( * ) Notice: Subject to any disclaimer, the term of this patent is extended or adjusted under 35 U.S.C. 154(b) by 1169 days.

(21) Appl. No.: 09/906,227

(22) Filed: Jul. 16, 2001

(65) Prior Publication Data

US 2003/0011201 A1 Jan. 16, 2003

(51) Int. Cl.
*E05B 3/00* (2006.01)
*E05C 19/00* (2006.01)

(52) U.S. Cl. ..... 292/348; 292/1; 292/336.3; 292/357

(58) Field of Classification Search ..... 292/336.3, 292/DIG. 21, 359, 169.14, 169.17, 169.12, 292/1, 348, 350, 356, 357; 70/107, 224, 70/210–212, DIG. 73
See application file for complete search history.

(56) References Cited

U.S. PATENT DOCUMENTS

| | | | | | |
|---|---|---|---|---|---|
| 987,271 | A | | 3/1911 | Upton | |
| 1,777,776 | A | | 10/1930 | Van Dooren | |
| 2,805,880 | A | * | 9/1957 | Brozek et al. | 292/357 |
| 2,846,255 | A | * | 8/1958 | Wardwell, Jr. | 292/169.22 |
| 3,065,624 | A | * | 11/1962 | Friedman | 70/153 |
| 3,713,683 | A | * | 1/1973 | Neary | 292/336.3 |
| 4,055,361 | A | * | 10/1977 | Moses | 292/359 |
| 4,099,756 | A | | 7/1978 | Kagoura | |
| 4,276,760 | A | * | 7/1981 | Nolin | 292/21 |
| 4,363,226 | A | | 12/1982 | Remington et al. | |
| 4,779,909 | A | * | 10/1988 | Hennessy | 292/166 |
| 4,982,986 | A | | 1/1991 | Gresset, Jr. et al. | |
| 5,010,278 | A | | 4/1991 | Kang et al. | |
| 5,018,375 | A | | 5/1991 | Tully | |
| 5,072,976 | A | * | 12/1991 | Meszaros | 292/207 |
| 5,084,940 | A | * | 2/1992 | Loffler et al. | 16/412 |
| 5,236,235 | A | * | 8/1993 | Gustafson et al. | 292/357 |
| 5,364,139 | A | | 11/1994 | Bergen et al. | |
| 5,368,406 | A | | 11/1994 | Hanshaw | |
| 5,433,495 | A | | 7/1995 | Uffner | |
| 5,490,696 | A | | 2/1996 | Hutson | |
| 5,492,380 | A | * | 2/1996 | Smallegan et al. | 292/140 |
| 5,513,510 | A | * | 5/1996 | Solovieff et al. | 292/169.14 |
| 5,593,193 | A | * | 1/1997 | Heim | 292/165 |
| 5,636,882 | A | * | 6/1997 | Hook | 292/359 |
| 5,651,568 | A | * | 7/1997 | Fortune et al. | 292/140 |
| 5,826,924 | A | | 10/1998 | Huang | |
| 5,890,385 | A | | 4/1999 | Lee | |

(Continued)

FOREIGN PATENT DOCUMENTS

GB 2241282 A * 8/1991

*Primary Examiner*—Carlos Lugo
(74) *Attorney, Agent, or Firm*—Richard J. Veltman; John D. DelPonti

(57) ABSTRACT

A dummy conversion bracket is used with a lockset having an interior assembly, an exterior assembly, and a thumbpiece. The thumbpiece is pivotally coupled to the exterior assembly and includes a tab that extends through the exterior assembly. The bracket comprises a blocking member disposed between the interior assembly and the exterior assembly. The blocking member is coupled to the exterior assembly and includes an aperture for receiving the tab. The aperture is configured to prevent the thumbpiece from pivoting relative to the exterior assembly.

5 Claims, 4 Drawing Sheets

U.S. PATENT DOCUMENTS 5,909,919 A * 6/1999 Wang ..... 292/359
6,082,790 A 7/2000 Mossotti et al.
6,532,629 B2 * 3/2003 Armstrong ..... 16/414

* cited by examiner

DUMMY CONVERSION BRACKET FOR A LOCKSET

The present invention relates to locksets in general and dummy locksets in particular. More particularly, it relates to dummy handlesets and a bracket adapted to prevent movement of the thumbpiece of the dummy handleset.

BACKGROUND OF THE INVENTION

In some installations, such as French doors, it is desirable to use a pair of locksets, typically handlesets, with one mounted on each door. At the same time, it is preferable to have one of the locksets operate the latching mechanism, with the other lockset being incapable of functioning. In the past, manufacturers have made add-on conversion kits that render a functional lockset inoperative by blocking the movement of the latch actuating mechanism. Unfortunately, such dummy locksets necessarily include many unused parts that add to the cost of the lockset without adding any value to the product.

In the case of a handleset, which uses a thumbpiece to actuate the latch, mere removal of the latch actuating mechanism would leave the thumbpiece unsupported. As a result, the thumbpiece would drop down to rest on the handle, giving the appearance of a broken handleset, which would be unacceptable to consumers.

SUMMARY OF THE INVENTION

A dummy conversion bracket is used with a lockset having an interior assembly, an exterior assembly, and a thumbpiece. The thumbpiece is pivotally coupled to the exterior assembly and includes a tab that extends through the exterior assembly. The bracket comprises a blocking member disposed between the interior assembly and the exterior assembly. The blocking member is coupled to the exterior assembly and includes an aperture for receiving the tab.

DETAILED DESCRIPTION OF THE INVENTION

Figure 1:
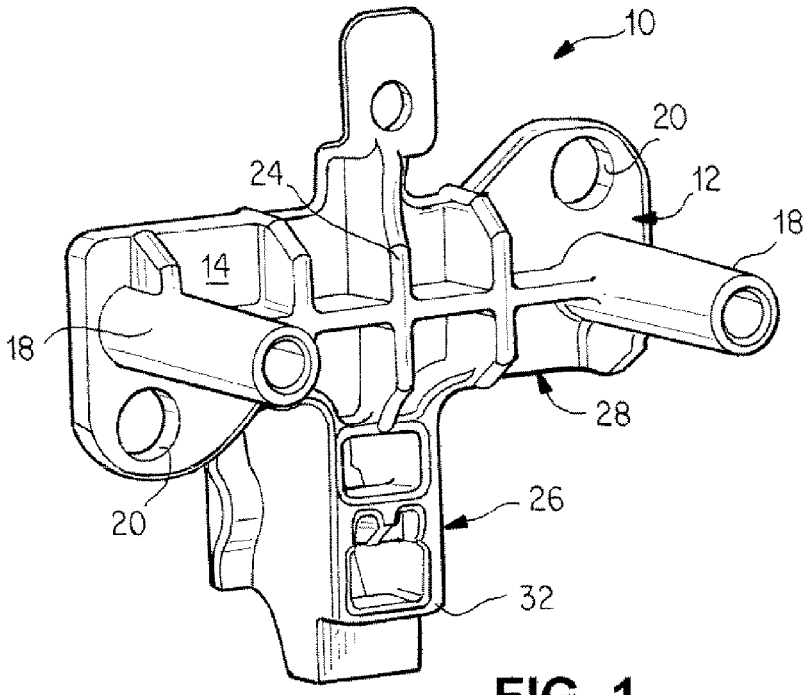
FIG. 1 is a front perspective view of a bracket according to the invention.
Figure 2:
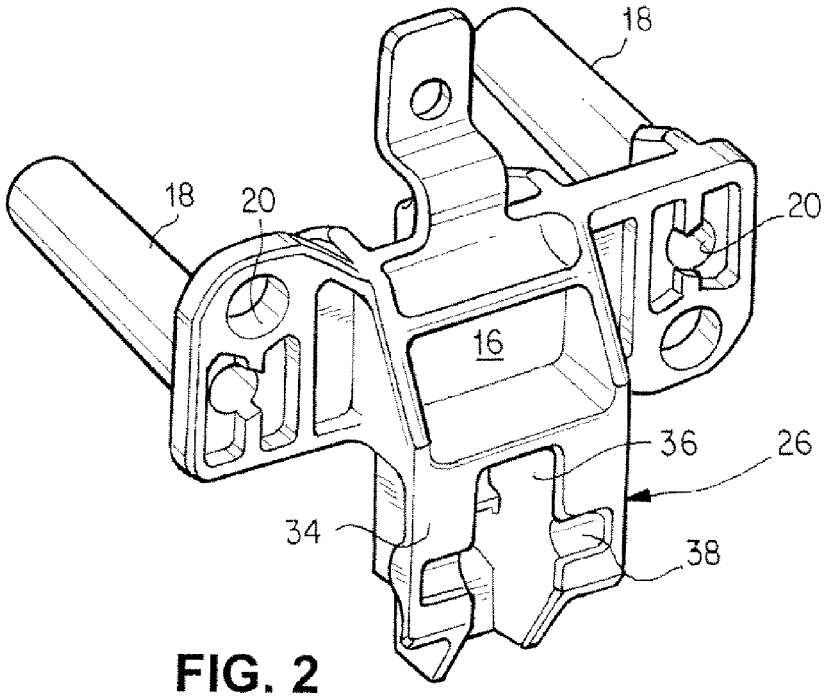
FIG. 2 is a rear perspective view of the bracket of FIG. 1.
Figure 3:
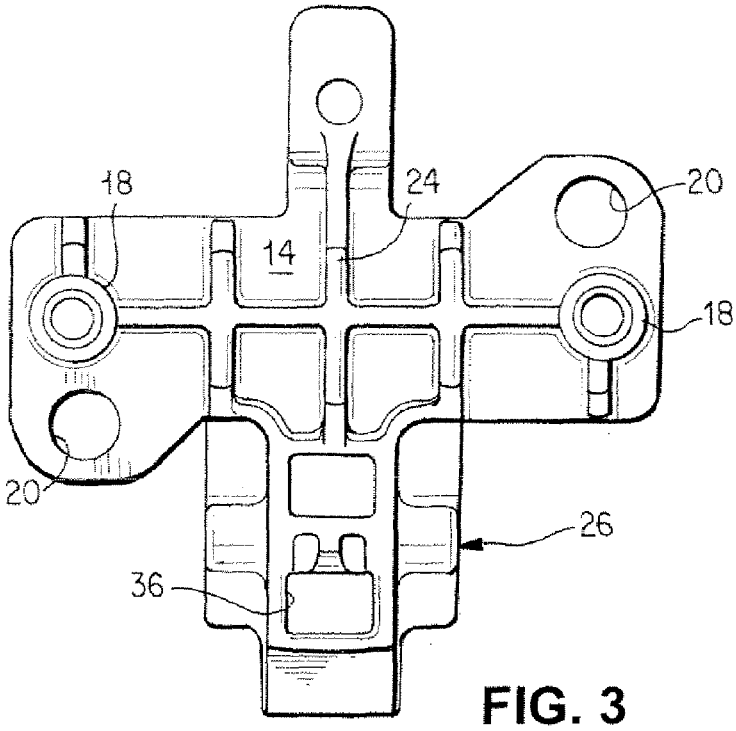
FIG. 3 is a front view of the bracket of FIG. 1.
Figure 4:
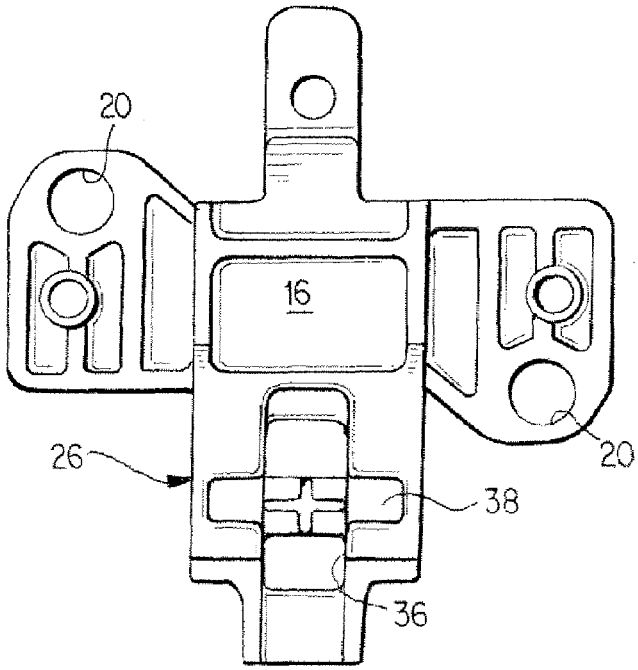
FIG. 4 is a rear view of the bracket of FIG. 1.
Figure 5:
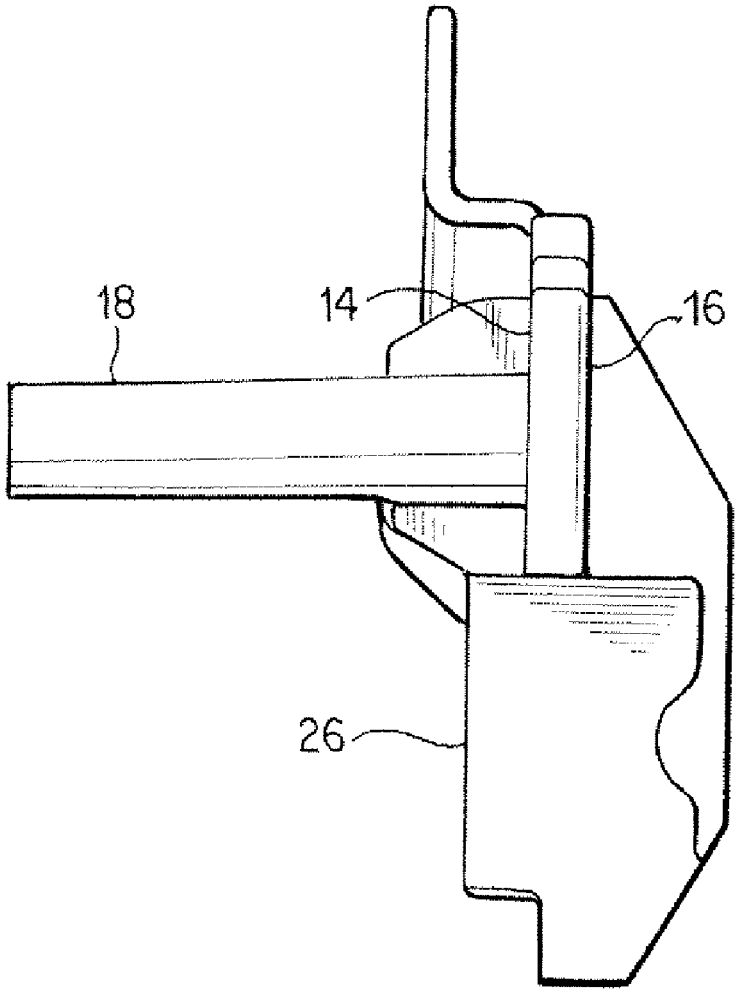
FIG. 5 is a side view of the bracket of FIG. 1.
Figure 6:
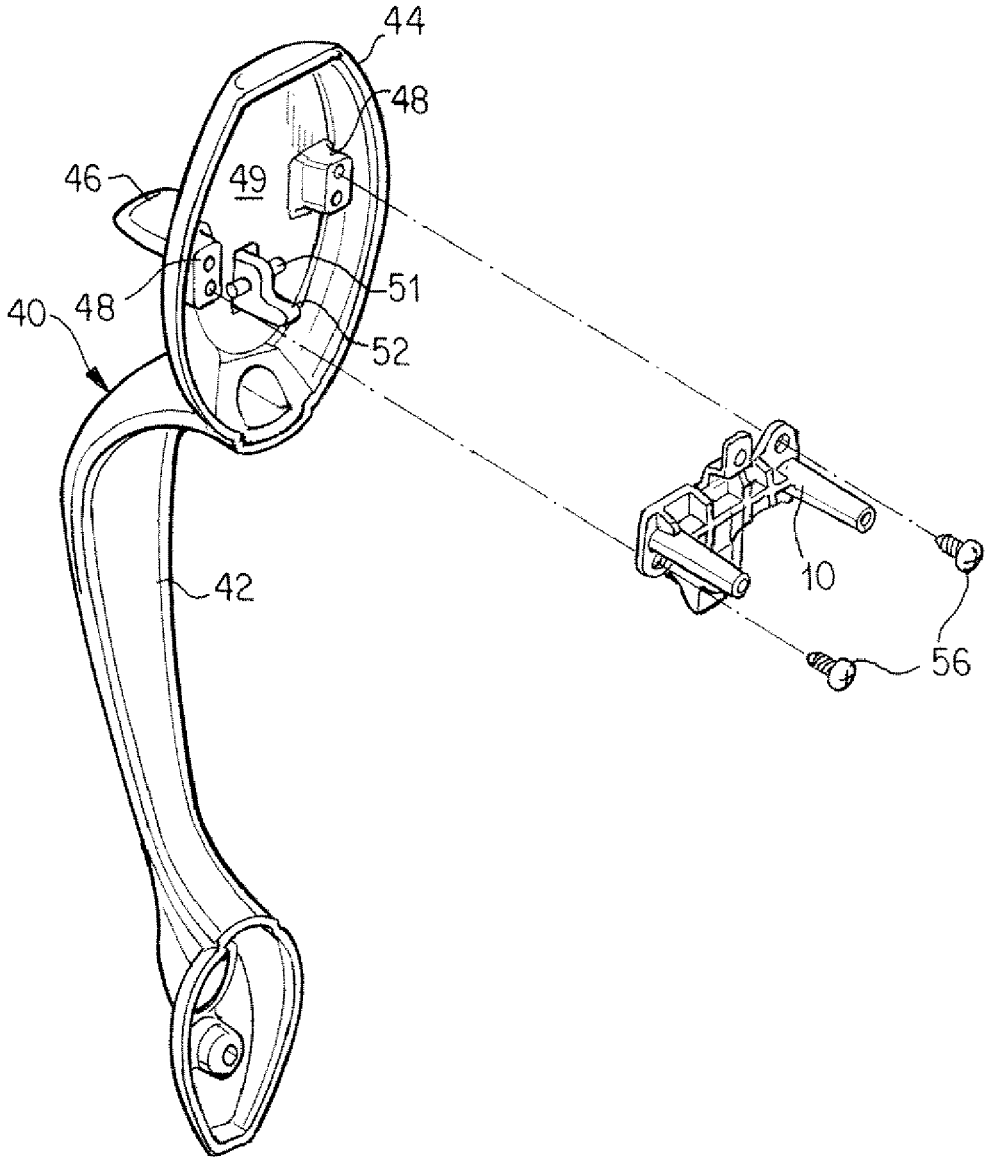
FIG. 6 is a perspective view of the bracket of FIG. 1 in position to be installed on a dummy handleset.

A bracket 10 according to the present invention is illustrated in FIGS. 1-5. The bracket 10 includes a backing plate 12 having a front surface 14 and a rear surface 16, a pair of posts 18 extending from the front surface 14, a pair of apertures 20 formed in the plate 12, and a grid 24 of strengthening walls extending outwardly from the front surface 14.

The bracket 10 further includes a blocking member 26 depending from the bottom edge 28 of the plate 12. The blocking member 26 includes a front surface 32, a back surface 34 and a rectangular tab-receiving opening 36 extending therebetween. A groove 38 is formed in the back surface 34 and extends outwardly from the opening 36.

A dummy handleset 40 includes a handle 42, an escutcheon 44, and a thumbpiece 46. The escutcheon 44 includes an interior surface 49 and a pair of bosses 48 formed on the interior surface 49. The thumbpiece 46 includes a tab 52 that extends through an opening in the escutcheon 44. The tab 52 includes a notch formed in its underside for receiving a pin 51 that acts as a retainer for the thumbpiece 46.

When the bracket 10 is operatively installed against the back of the escutcheon 44, the tab 52 extends into the tab-receiving opening 36 with the pin 51 disposed in the groove 38. A pair of fasteners 56 extend through the apertures 20 in the backing plate 12 and engage the escutcheon 44 to retain the bracket 10 in position. When in position, the bracket 10 traps the pin 51, retaining the thumbpiece 46 in the escutcheon 44. The tab-receiving opening 36 is sized to prevent movement of the thumbpiece 46.

The above-described embodiments, of course, are not to be construed as limiting the breadth of the present invention. Modifications and other alternative constructions will be apparent which are within the spirit and scope of the invention as defined in the appended claims.

The invention claimed is:

1. A dummy conversion bracket for use with a lockset, the lockset having an interior assembly, an exterior assembly, and a thumbpiece, the bracket comprising:

a blocking member disposed between the interior assembly and the exterior assembly and coupled to the exterior assembly, the blocking member including an aperture for receiving the thumbpiece, the aperture being configured to restrain movement of the thumbpiece.

2. The bracket of claim 1 wherein the blocking member further includes a plate coupled to the exterior assembly and a pair of posts coupled to the plate, the posts being configured for engaging fasteners to couple the interior assembly to the exterior assembly.

3. The bracket of claim 1 wherein the exterior assembly includes an escutcheon and the thumbpiece includes a tab extending through escutcheon and a pin for retaining the thumbpiece.

4. A dummy conversion bracket for use with a lockset the lockset having an interior assembly, an exterior assembly, and thumbpiece pivotally coupled to the exterior assembly, the bracket comprising:

a blocking member coupled to the exterior assembly and having an aperture, the aperture being configured to receive a portion of the thumbpiece and prevent the thumbpiece from pivoting relative to the exterior assembly and the interior assembly.

5. The bracket of claim 4 wherein the blocking member includes a plate having a pair of posts for coupling the interior assembly to the exterior assembly.

* * * * *